US005795195A

United States Patent [19]

Karlsberger

[11] Patent Number: 5,795,195

[45] Date of Patent: Aug. 18, 1998

[54] ELECTRICAL PLUG

[76] Inventor: Mark A. Karlsberger, 165½ E. Winter St., Delaware, Ohio 43015

[21] Appl. No.: 717,978

[22] Filed: Sep. 23, 1996

[51] Int. Cl.[6] ..... H01R 4/50

[52] U.S. Cl. ..... 439/783; 439/807

[58] Field of Search ..... 439/783, 794, 439/807

[56] References Cited

U.S. PATENT DOCUMENTS 3,315,059 4/1967 Jacks et al. ..... 439/807

5,423,699 6/1995 Jonnson ..... 439/783

*Primary Examiner*—Gary F. Paumen

*Assistant Examiner*—T. C. Patel

*Attorney, Agent, or Firm*—Thomas S. Baker, Jr.

[57] ABSTRACT

An electrical plug assembly for an alternator rectifier receptacle has a wedge element that cooperates with a rigid housing to securely clamp the rectifier prongs.

1 Claim, 2 Drawing Sheets

FIG. 1
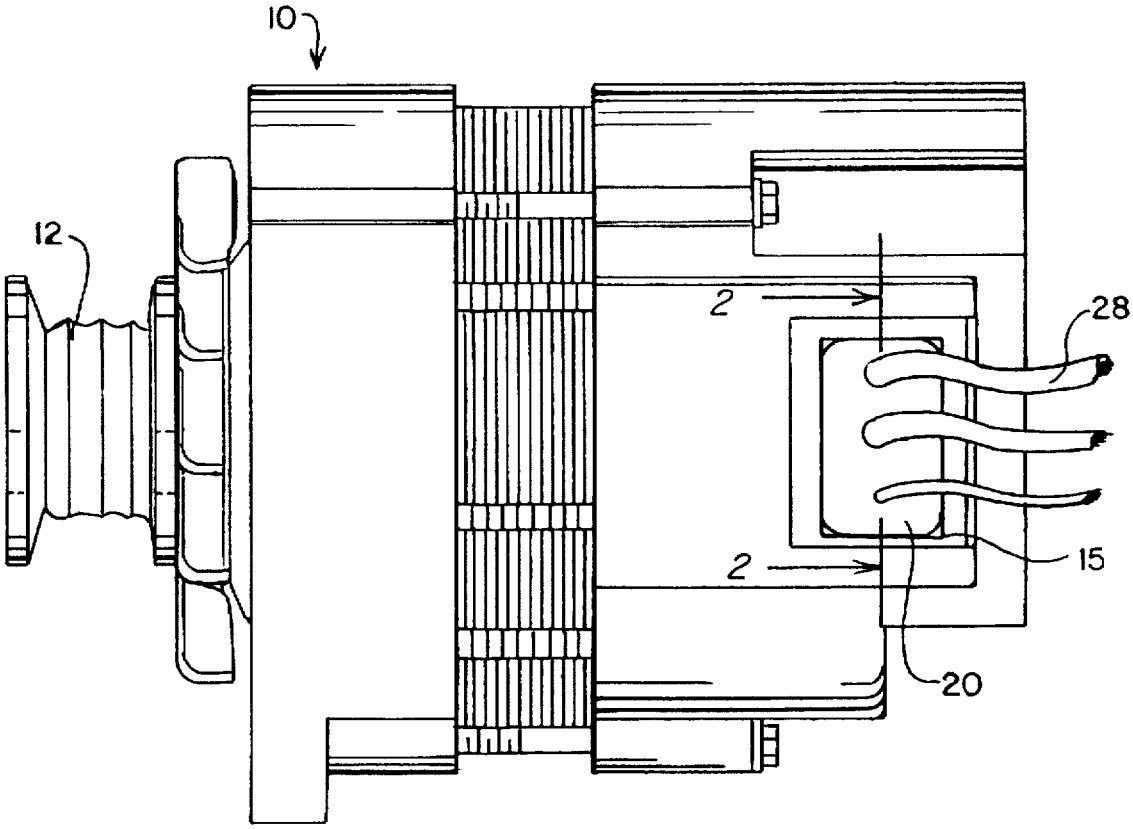
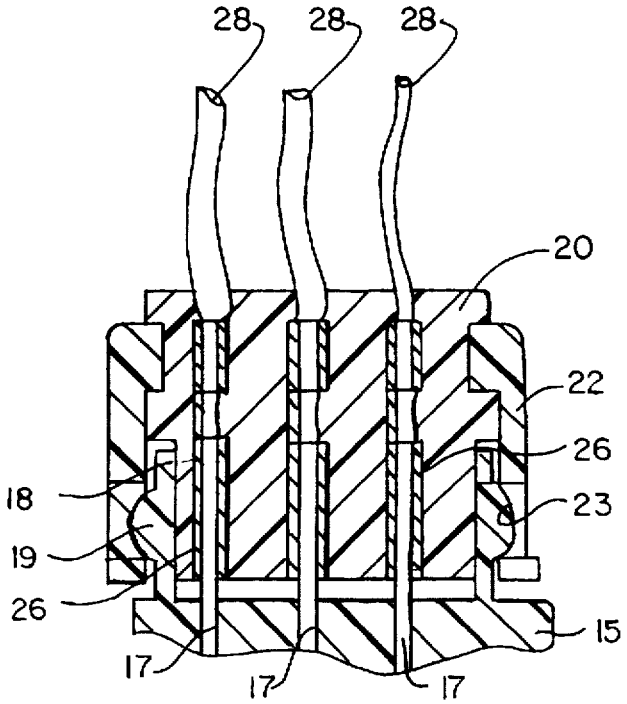
FIG. 2
PRIOR ART

ELECTRICAL PLUG

FIELD OF THE INVENTION

The invention relates generally to retrofitting conventional plugs used with prong-type electrical receptacles with a metallic wedge-type plug connected to at least one wire. The wedge-type plug provides a secure, electrical conductive connection which generally resists loosening due to vibration and thus substantially eliminates the need for replacement of various electrical components which fail because of loose connections such as alternator rectifiers.

BACKGROUND OF THE INVENTION

Many automotive alternators utilize a rectifier receptacle having three parallel flat-blade prongs. Often, two adjacent prongs are utilized to pass high amperage currents in the amount of from about 60 to about 90 amps between an alternator rectifier and an automotive battery. A third prong generally passes a low current to a voltage regulator. Typically, the flat blade prongs are inserted into a plug having three conventional spring-type connectors. This construction has resulted in problems in that the spring-type connectors loosen with time and use from the flat blade prongs due to vibration, etc., resulting in overheating of the electrical connection due to increased electrical resistance and/or arcing. Ultimately, some rectifiers are destroyed, and in some cases the heat buildup in the rectifier may become large enough to cause under hood automotive fires to occur.

SUMMARY OF THE INVENTION

The electric plug of the present invention is generally comprised of a metallic housing which is a U-shaped and has a base and at least two legs extending therefrom. A bore extends through the base and is capable of slidably receiving a bolt therethrough. Preferably, the legs of the housing are tapered so that they are narrower at their outer ends than at the base. A metallic polygonal wedge element having a trapezoid shape is located between the legs of the U-shaped member such that the greatest width of the trapezoid is adjacent the ends of the legs. A small clearance exists between the wedge element and the two legs so that a prong or blade of an electrical receptacle can reside on each side of the wedge element. The wedge element has a threaded aperture for receiving a bolt passing through the bore in the housing. When the bolt is rotated, the wedge element is drawn into and between the legs of the housing and forms a secure engagement with each prong wedged between a leg and the wedge element.

In an alternate embodiment, a threaded bolt having a taper at the outer end thereof is drawn into a fork-shaped housing between two depending legs to spread the legs apart and force the same into a secure contact with two receptacle prongs.

BRIEF DESCRIPTION OF DRAWINGS

FIG. 1 is an elevational view of an alternator containing a rectifier connected to a plug having three wires extending therefrom;

FIG. 2 is a cross-sectional view along line 2—2 of FIG. 1 illustrating a prior art device.

DETAILED DESCRIPTION PRIOR ART

Figure 3:
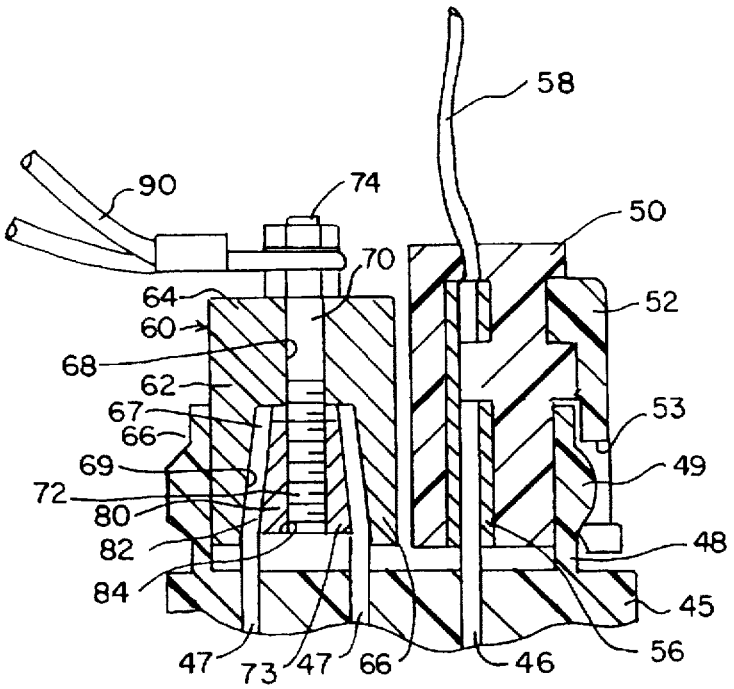
FIG. 3 is a cross-sectional view of a preferred embodiment of the electrical plug of this invention.

FIG. 1 illustrates a prior art automobile alternator 10 containing various conventional structure including a belt-driven pulley 12. Alternator 10 contains a rectifier receptacle 15 which receives a plug assembly 20 having wires 28 which generally transfer current between the alternator rectifier and a battery. As shown in FIG. 2 rectifier receptacle 15 has three flat-blade prongs 17 extending therefrom. The receptacle 15 also has a pair of receptacle retainers 18 extending upwardly therefrom each having a lateral offset portion 19 thereon.

An electrical plug 20 has a pair of side latches 22, each having a lateral recess 23 therein. Side latch recesses 23 are complementary to receptacle retainers 18 to ensure that plug 20 is securely fastened to rectifier receptacle 15. Plug 20 preferably is made of an insulating material such as rubber or plastic and contains metal spring connectors 26 therein which receive the flat-blade plug prongs 17. Each metal spring connector 26 has at least one wire 28 extending therefrom. It has been found that the clamping action of the spring connectors 26 on receptacle prongs 17 diminishes with usage and over time due to vibration, jarring, etc.

DESCRIPTION OF THE INVENTION

FIG. 3 illustrates a rectifier receptacle 45 on a generator which is substantially the same as that disclosed in FIG. 2. That is, rectifier receptacle 45 has one low-current blade type prong 46 and two high-current blade type prongs 47 extending therefrom. It also has two receptacle retainers 48 at least one having a lateral offset portion 49. An electrical plug 50 which connects a wire 58 to receptacle prong 46 preferably contains a lateral side latch 52 which has a recess 53 therein. The recess complements retainer lateral offset portion 49 and fastens the receptacle to the plug. Plug 50 is made of an insulating material such as rubber or plastic and contains a metal clamping type spring connector 56 therein.

Referring again to FIG. 3, the electrical plug assembly 60 of the instant invention comprises a metallic generally U-shaped housing 62, a bolt 70, and a metallic wedge element 80. The housing 62 has a base 64 with two downwardly depending lateral legs 66 which define a recess 67 located therebetween. Preferably the inside surface 69 of both legs is slightly tapered such that the outer end of or bottom portion of the legs is narrower than the top leg portion adjacent to base 64. The degree of taper may vary from about 0.1 to about 10 degrees. Preferably the taper is in a range between 0.5 and 1 degrees. The thickness of each leg 66 is sufficient such that they are rigid and cannot be moved in a lateral outwardly direction. Housing 62 also has an axial bore 68 extending through base portion 64 centrally of leg 66. Bolt 70 has a threaded end portion 72 and extends through axial bore 68 to engage wedge element 80 as described hereinbelow.

Wedge element 80 is adapted to be positioned within the recess 67 defined between the high current prongs 47 within the legs 66 of housing 62. Wedge element 80 may be of any desired shape such as triangular, square, hexagonal, etc. but preferably is trapezoidal as shown in FIG. 3 with the widest part or base 73 of the trapezoid being located adjacent the outer ends of housing legs 66 between adjacent prongs 47 of receptacle 45. Moreover, the trapezoidal wedge element 80 preferably has a shape complementary to the inner surfaces 69 of legs 66 in that outer surfaces 82 of wedge element 80 are tapered to the same degree as that of the inner leg surfaces 69. That is, the outward sides 82 have a taper extending laterally inwardly from about 0.1 to about 10 degrees and preferably from about 0.5 to about 1 degrees. The two remaining sides of the wedge element 80, may be but need not be tapered. As mentioned above, the width of the bottom portion 73 of wedge element 80 is generally sized such that when housing 62 is inserted into rectifier receptacle 45, one prong 47 is located between a leg inner surface 69 and a lateral side 82 of wedge element 80 as shown in FIG. 3. The width of the wedge base 73 is sufficient to prevent rotation of the wedge element 80 between the two prongs 47. Wedge element 80 also has a threaded axial bore 84 which extends therethrough and receives the threaded portion of bolt 70.

The assembly of electrical plug 60 is as follows. Wedge element 80 is inserted in receptacle 45 between adjacent prongs 47 with its base 73 positioned downwardly. Housing 62 is then inserted into the rectifier receptacle 45 such that each prong 47 extends into the portion of recess 67 between the lateral inside surface 69 of a housing leg 66 and a side surface 82 of wedge element 80 as shown in FIG. 3. Bolt 70 is subsequently threaded into wedge bore 84 to cause wedge element 80 to be drawn upwardly into recess 67. Inasmuch as the inside surfaces 69 of the housing legs 66 are tapered and the sides 82 of wedge element 80 are tapered also each prong 47 will be securely wedged or clamped against the inside surface 69 of a housing leg 66. Where the taper of the wedge element sides 82 matches that of the inside surfaces 69 of the housing legs, maximum surface-to-surface contact is realized therebetween with each side of the receptacle prong.

The head 74 of bolt 70 may serve as a terminal for connecting wires 90 to the plug assembly 60. Thus, the electrical plug assembly 60 of the present invention provides a rigid connection between the receptacle prongs 47 and wires 90.

Figure 4:
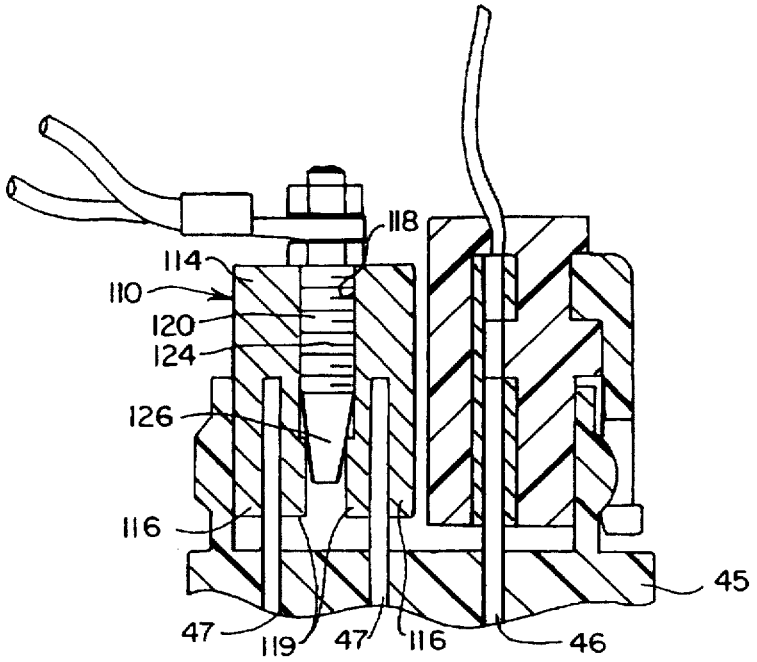
FIG. 4 is a cross-sectional view of an alternative embodiment of the electrical plug of this invention.

An alternative embodiment of a wedge type electrical plug assembly 110, for providing a secure engagement with prongs 47 of rectifier receptacle 45 may be seen by referred to in FIG. 4. Inasmuch as plug 50 for engaging the low current prong 46 is generally the same as shown in FIG. 3, the same will not be discussed. Rather, it is hereby fully incorporated by reference wherein like numbers refer to like parts. An electrical plug assembly 110 has a fork-shaped metallic housing 112 formed with a base portion 114, an outer pair of downwardly depending legs 116 and an inner pair of downwardly depending legs 119. Outer legs 116 are sized to be rigid whereas inner legs 119 are sized to permit limited lateral movement. The distance between adjacent inner and outer legs 116 and 119 is slightly greater than the thickness of a rectifier receptacle prong 47. A threaded central bore 118 extends through base portion 114 centrally of the inner legs 119. Bore 118 is threaded in base portion 114 and reduced in diameter between legs 119. The reduced diameter extends between inner legs 119. A bolt 120 having a threaded base portion 124 which is complementary to the threaded portion of central bore 118 and a tapered outer end portion 126 is received in bore 118.

The plug assembly 110 is utilized by placing housing 112 over rectifier receptacle 45 such that outer legs 116 are located outwardly of each prong 47 and inner legs 119 are located inwardly of each prong 47. Thereafter bolt 120 is rotated into threaded bore 118. As bolt 120 is threaded into the bore, tapered portion 126 thereof engages the reduced diameter portion of bore 118 between both inner legs 119 and biases them laterally outwardly. This causes the inner legs 119 to engage the receptacle prongs 47 and wedge them against the inside surfaces of the outer legs 116. A secure electrical connection is thereby obtained between the fork-shaped housing 112 of plug assembly 110 and prongs 47 of the receptacle.

Since certain changes may be made in the above-described metallic wedge assembly without departing from the scope of the invention hereinabove, it is intended that all matter contained in the description and shown in the accompanying drawing shall be interpreted as illustrative and not in a limiting sense.

I claim as my invention as follows:

1. An electrical plug for securing a wire to an alternator receptacle having a pair of prongs therein, comprising;

a metallic housing having a base portion, an outer pair of downwardly depending legs and an inner pair of downwardly depending legs, a partially threaded bore extending through said base portion central of said inner pair of legs, said bore having a reduced diameter portion, between said inner pair of legs; and a fastener having a tapered outer end portion adapted to engage said housing bore such that upon engagement of said fastener with said threaded portion of said bore, said bolt is drawn downwardly into said bore toward said inner pair of legs and said bolt tapered outer end portion engages said reduced diameter bore portion between said inner legs and biases them laterally outwardly toward said outer legs.

* * * * *